US007044469B1

(12) United States Patent
Bushman et al.

(10) Patent No.: US 7,044,469 B1
(45) Date of Patent: May 16, 2006

(54) GAME INVOLVING MULTIPLE COMMUNICATION METHODS

(76) Inventors: Earl Bushman, 1300 Walsh Tarlton, Austin, TX (US) 78746; Owen Davis, 12 Sugar Creek Dr., Austin, TX (US) 78746; Gary Jaffe, 1307 Silver Hill Dr., Austin, TX (US) 78746; Jamie Peco, 1301 Silver Hills, Austin, TX (US) 78746; David Saad, 4906 Mantle Dr., Austin, TX (US) 78746; Aaron Scheinberg, 104 Riley Rd., Austin, TX (US) 78746

( * ) Notice: Subject to any disclaimer, the term of this patent is extended or adjusted under 35 U.S.C. 154(b) by 220 days.

(21) Appl. No.: 10/442,684

(22) Filed: May 21, 2003

Related U.S. Application Data

(60) Provisional application No. 60/382,778, filed on May 21, 2002.

(51) Int. Cl.
*A63F 1/00* (2006.01)

(52) U.S. Cl. ..... 273/429; 273/432

(58) Field of Classification Search ..... 273/429, 273/430, 431, 432, 440
See application file for complete search history.

(56) References Cited

U.S. PATENT DOCUMENTS

| | | | | |
|---|---|---|---|---|
| 4,927,147 | A | 5/1990 | Delzio | |
| 4,932,667 | A * | 6/1990 | Gorski et al. | 273/249 |
| 5,135,234 | A | 8/1992 | Finch | |
| 6,279,909 | B1 * | 8/2001 | Alexander, II et al. | 273/249 |

OTHER PUBLICATIONS

Communications in Sign, by Diane P. Chambers, (New York: Fireside Publishing), 1998, content pages http://www.powells.com/biblio!show=TRADE%20PAPER:USED:0684835207:7.95&page=excerpt, 14 pgs.*

Milton Bradley, Pictionary Rules, Pictionary Inc., 1985.

Dana S. Nau, Rules for the Game of Charades, Mar. 12, 2000.

* cited by examiner

*Primary Examiner*—William M. Pierce
(74) *Attorney, Agent, or Firm*—Michael O. Scheinberg

(57) ABSTRACT

A game combines two forms of communication, which, in preferred embodiments, are acting and drawing. In those embodiments, certain players try to act ideas presented on cards to drawers, who use dry-erase boards to draw, for different ends based on the specific embodiment.

5 Claims, 9 Drawing Sheets

GAME INVOLVING MULTIPLE COMMUNICATION METHODS

This application claims priority from U.S. Provisional Patent Application No. 60/382,778, filed May 21, 2002, which is hereby incorporated by reference.

FIELD OF INVENTION

This invention relates to games in which two parties concurrently attempt to communicate ideas to each other and, in some embodiments, to games involving drawing and acting.

DESCRIPTION OF PRIOR ART

Charades and Pictionary® are well known games. There are several downsides, however, to Pictionary. For one thing, players don't always like to draw. Pictionary would only bore these people and offers no alternatives. It is also impossible, in this game, to play with odd numbers of players. Pictionary also has a board, which creates complications that are unnecessary for the actual game play. These factors, among others, invariably slow the game. Charades has its own problems. For one thing, it has no organized system of points. This reduces competition. Also, few people like to act, and Charades offers little else to do. Both games are limited to a certain number of people, and only one team can play at a time. When some people sit out, it reduces the inclusive atmosphere that makes these games appealing. Additionally, there is little or no interaction between those players who are guessing.

SUMMARY OF THE INVENTION

Different embodiments of the present invention can solve all of these disadvantages.

A game in accordance with the invention includes two sides that are simultaneously communicating one or more messages to each other, the two sides using different communication methods.

In accordance with one preferred embodiment, one or more first players attempt to convey a first communication to one or more second players using a first communication method. Concurrently, one or more second players attempt to convey to the one or more first players a second communication using a second communication method. The first communication method and the second communication method preferably require some level of creativity in conveying and interpreting the communication. For example, the first communication method may include acting and the second communication method may include drawing.

In one embodiment, the second communication comprises the second player's understanding of what the first communication is. For example, a first player draws a card indicating a phrase to be conveyed, and the first player attempts to convey that phrase using a first communication method, such as acting. A second player attempts to understand the first communication, and then attempts to communicate back to the first player using a second communication method, such as drawing, his understanding of the first communication. When the first player believes that the second player has accurately understood the first communication, the play is stopped and the second player records his understanding of the first communication, which is then compared to the card previously drawn by the first player. If the second player has successfully interpreted the first communication, both players are deemed successful for that round of play.

In other embodiments, the second player may attempt to communicate a second communication that is related to, but different from, the first communication. For example, each of two players may be given one part of a multipart phrase, and each player then attempts to communicate his portion of the phrase to the other player using his respective communication method. When one or both parties believe that the phrase is known, the play is stopped and each player records or states his or her understanding of the phrase. The understandings are compared to the actual phrase, and the players are deemed successful for that round of play if the phrase was correctly deduced by one or both players.

Although described above with respect to two players, the game is not limited to a particular number of players. One or more players can be acting while one or more players are drawings. Some of the various embodiments of the game as described above include:

- a two player game, such as basic Pixades (described below);
- a team game with rules similar to those of the basic Pixades, but in which the teams switch off, that is, one team is drawing and acting while the other team or teams are idle; and
- a team game, such as Pandemonium Pixades (described below) with rules similar to those of the basic Pixades, but in which all teams are simultaneously playing.

The messages that are being communicated between the players can also be varied. As described above, in some embodiments, second players are trying to understand the messages of the first players and convey that understanding back to the first players. In others, such as Double-Time Pixades (described below), second players are communicating a second message related to the first message, such as the second half of a well-known phrase. The variations in the messages can be combined with the variations in player combinations to make a wide variety of games that are within the scope of invention.

Because the game involves more than one method of communication, players that do not like one method may chose a different method. Embodiments of the present invention can be played without using a board. In some embodiments, the game is not limited to a specific number of players, so any number of people can play simultaneously, thereby keeping everyone who wants to play involved in the game.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

DETAILED DESCRIPTION OF PREFERRED EMBODIMENTS

Several preferred embodiments, referred to as Pixades™ and its variants, entail at least one player communicating by drawings and at least one player communication by acting. Pixades™ gives the option of acting or drawing with any number of people. Pixades™ does not have a board, which results in faster game play and creates a unique, unconventional system of play. Pixades™ has an organized system for points that maintain competition and enthusiasm, and also reduces confusion over the "winner." Pixades™ allows more than one team to play at one time; Pixades™ keeps everyone in the game, all the time. This means that no one will ever be force to sit out. That and previously mentioned reasons allow the game to keep up a swift pace. Pixades™ also creates the opportunity for interaction between players. The game is much more enjoyable than other games because it encourages interaction between actor(s) and drawer(s), drawer and drawer, and actor and actor.

Figure 1:
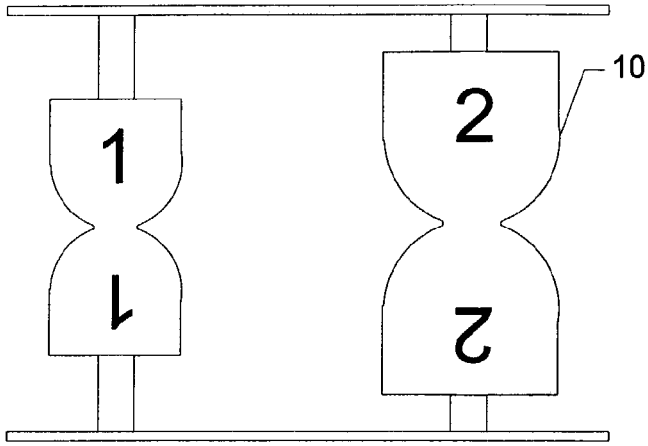
FIG. 1 shows timers that are used in the preferred embodiments to measure the length of rounds of the game for the purpose of scoring.
Figure 2:
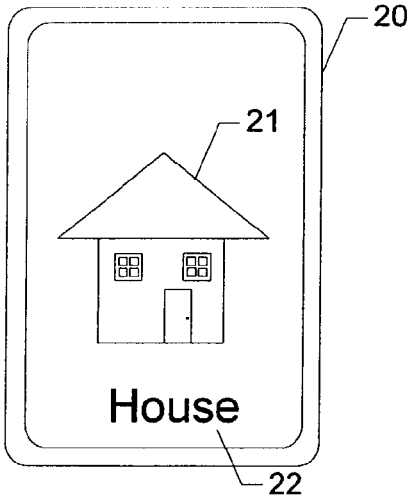
FIG. 2 shows a dry-erase board that certain players draw on during gameplay.
Figure 3:
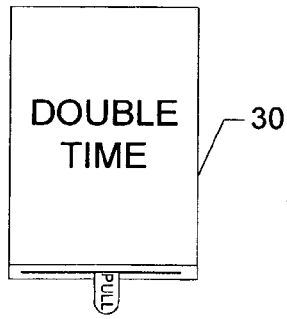
FIG. 3 shows a Double-Time card holder used to hold Double-Time answer cards.
Figure 4:
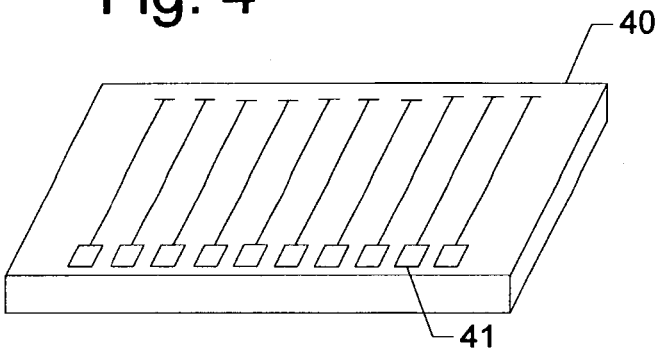
FIG. 4 shows a scoreboard used to keep track of all scoring to easily determine the winner of the game.
Figure 5:
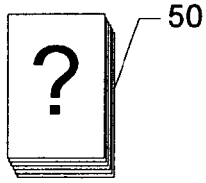
FIG. 5 shows answer cards, on each of which is a word, used in gameplay.
Figure 6:
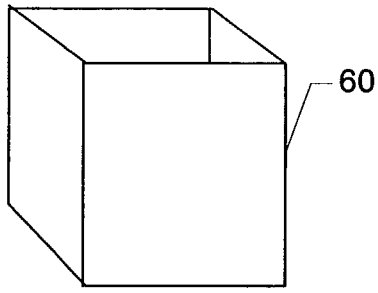
FIG. 6 shows a cardholder used to store answer cards during gameplay.
Figure 7:
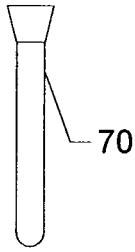
FIG. 7 shows a dry-erase marker used to draw on the dry-erase board.
Figure 8:
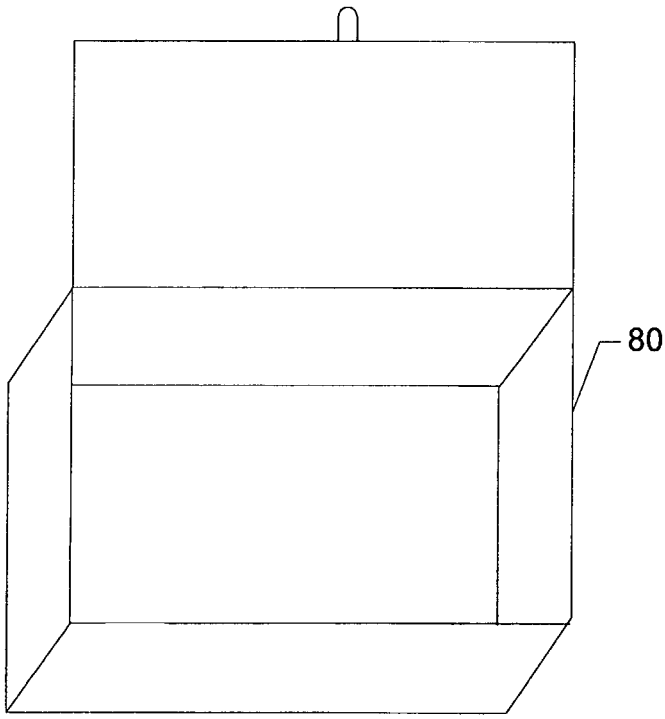
FIG. 8 shows a box that contains the other parts of the embodiment when the game is not being played and can also be used in some embodiments as a barrier to prevent certain players from seeing each other's dry-erase boards when the rules of the game call for this.

A kit for facilitating gameplay can include the following contents:

Timer (FIG. 1)
Dry Erase Boards (FIG. 2)
"Double-Time" card holder (FIG. 3)
Scoreboard (FIG. 4)
Cards (FIG. 5)
Card holder (FIG. 6)
Dry Erase Markers (FIG. 7)
Box (FIG. 8)

Each player or team is represented on a scoreboard 40. The object of the game is, through acting and sketching, for a player to move his marker 41 from 1–10 on the scoreboard 40 by scoring points. Of course, any type of scorekeeping mechanism, such as a simple notepad could be used, and the number of points required to win or the allocation of points can be varied.

In order to begin the game, one performs the following setup procedure shown in FIGS. 9–14 as 900, 1000, 1100, 1200, 1300, and 1400, respectively, depending on which embodiment is being played:

1. Remove objects from box 80. Place the cards 50 in the card holder 60.
2. Set all of the game score markers 41 on zero.
3. Divide players into teams as called for by the specific embodiment.
4. Proceed to main play.

Figure 9:
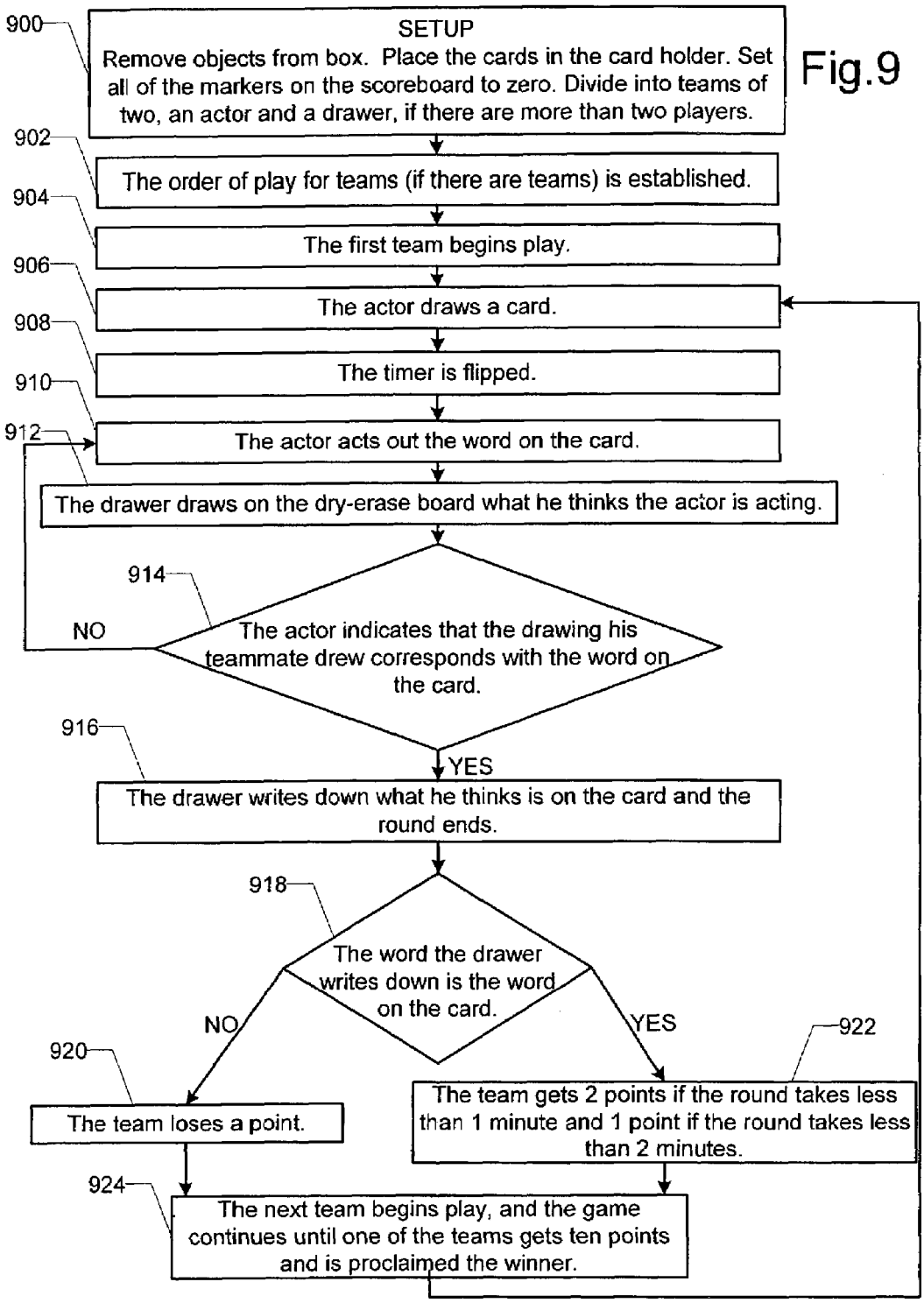
FIG. 9 is a flowchart showing the steps of a preferred embodiment of the inventive game.

The basic game of the Pixades embodiment, shown in FIG. 9, is for two players. FIG. 9 also describes the team version of the basic game, and thus steps 902 and 904, referring to the team game, are not used in the two-play game. One player is an actor and the other is a drawer. In step 906, the actor draws a card 50 having a word, phrase, image, or other expression thereon to be communicated to the drawer. Other methods of assigning to the actor the communication to be conveyed can be used, for example, having a computing device randomly produce the communication.

The drawer flips the timer 10 (step 908) and the actor tries to convey, through acting, the word written on the card 50 (step 910). The drawer draws on his dry-erase board 20 what he believes the actor is trying to act (step 912). If the actor thinks that an illustration 21 drawn by the drawer on his board is not what is written on the card 50, the actor will signal this (step 914), and the drawer will erase and start again. If the actor thinks that what the drawer illustrates on his board is what is written on the card 50, the actor will signal that (step 914). The drawer then writes down a word 22 that he thinks is the word on the card 50 (step 916).

If it is determined in step 918 that the word the drawer wrote down is correct and the round took less than a minute, the two players receive two points (step 922) and move their marker 41 up two notches on the scoreboard 40. If the round takes less than two minutes, they receive one point (step 922) and move their marker 41 up one notch on the scoreboard 40. If the round takes more than two minutes, no points are to be awarded. If he is incorrect (step 920), the two players lose a point and move their marker 41 down a notch on the scoreboard 40. The actor must be completely silent while playing, and the drawer cannot say anything about what he thinks the word is. Players may switch roles after each round if they desire. The object of the two-player version of the basic game is to get to ten points on the scoreboard 40 in the smallest amount of rounds possible (step 924).

The basic game can also be played with teams. In this embodiment, the rules from the above paragraphs remain the same. The only difference is that the teams (of two players each one drawer and one actor) take turns playing the game. The same rules apply regarding scoring and playing. The goal of this option is to be the first team to get to ten on the scoreboard 40.

In addition to the previously mentioned basic embodiments of the invention, there are also several more advanced embodiments.

Figure 10:
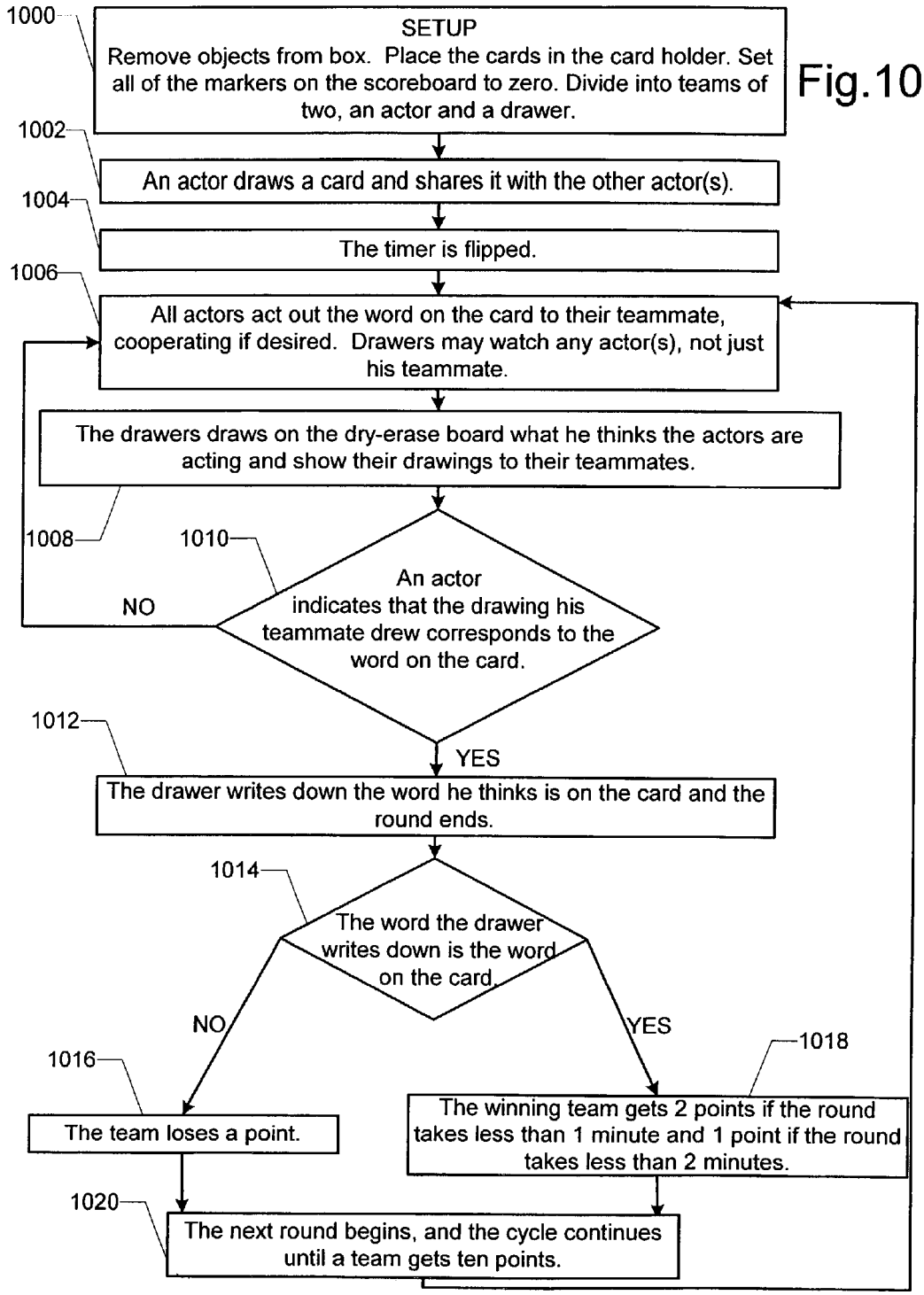
FIG. 10 is a flowchart showing the steps of another preferred embodiment of the inventive game.

Pandemonium Pixades, shown in FIG. 10, is one of these embodiments. This version of the game can be played with two or more teams consisting of two players. Players divide themselves into said teams and then each team divides into a drawer and an actor (step 1000), just as they would do if playing basic team Pixades. Then, in step 1002, one actor draws a card 50 and shares it with the other actor(s) from the other teams. The timer 10 is flipped (step 1004) and play commences. All actors try to act out the word to their teammate (step 1006). The drawers can look at any of the actors. For example, if the actor on Team A is doing a poor job of acting the word and the actor on Team B is doing a great job, the drawer on Team A can try to guess by means of Team B's actor's performance. The actors may interact to convey a clearer picture. When one of the drawers thinks he knows the word on the card, he draws an illustration 21 on his board 20 and shows it to the actor on his team (step 1008). The actor indicates whether the drawing his teammate drew corresponds with the word on the card 50 (step 1010). If he indicates that it is, then the drawer writes down the word he thinks is on the card and the round ends (step 1012). Steps 1014–1020 for scoring are similar to the corresponding steps of FIG. 9 described above.

Figure 11:
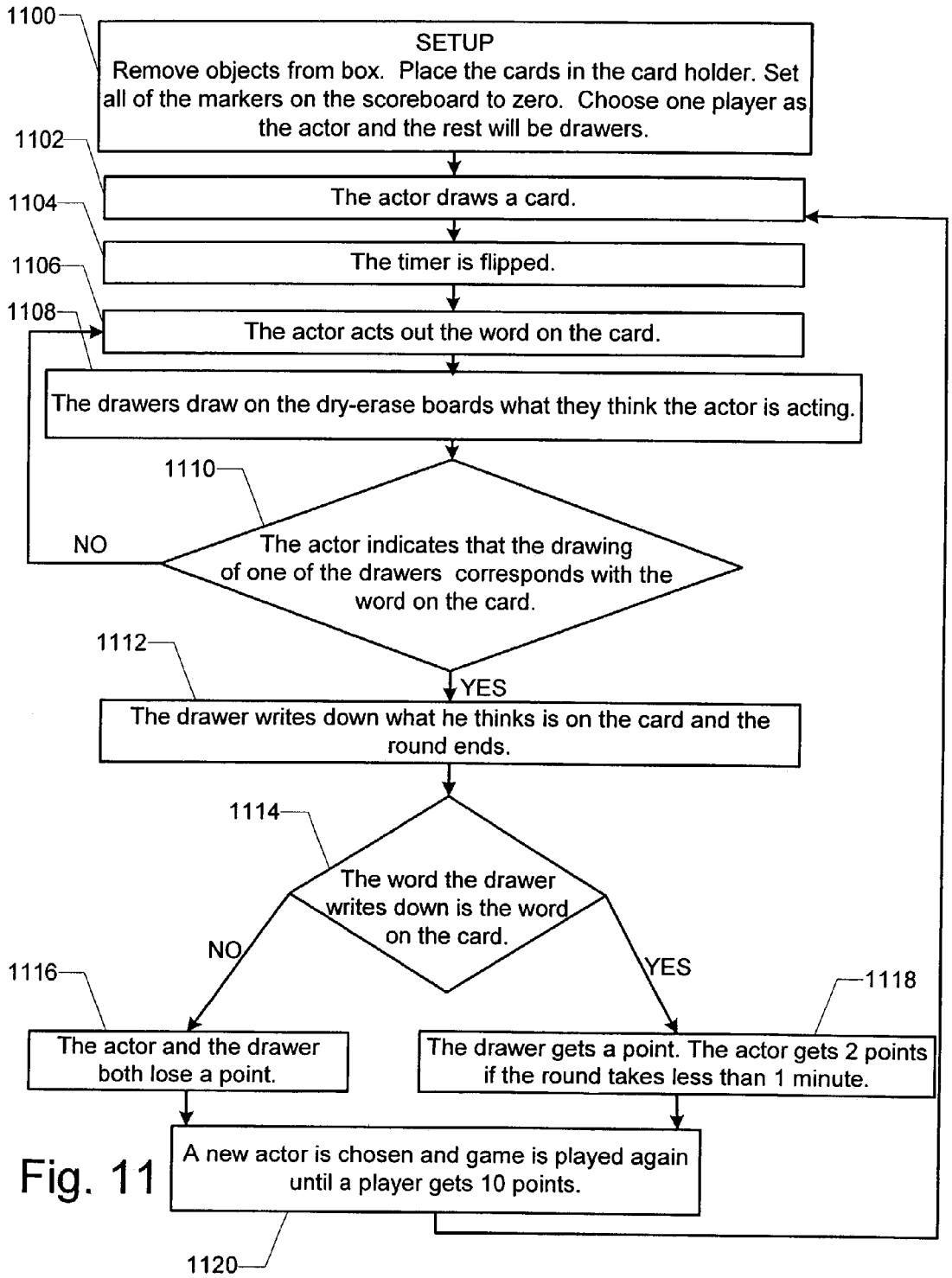
FIG. 11 is a flowchart showing the steps of yet another preferred embodiment of the inventive game.

Another embodiment, referred to as "Free-For-All Pixades™," can be played with three or more players and is shown in FIG. 11. In this embodiment, there are no teams. Everyone gets his own marker 41 on the scoreboard 40. One actor is chosen (step 1100), and he draws a card 50 (step 1102). The timer is flipped (step 1104), and the actor acts (step 1106) to convey the word to the drawers. If a drawer thinks he understands, he draws the illustration 21 and shows it to the actor (step 1108). If the actor believes that the drawer is correct, he will give a sign (step 1110). The drawer writes down a word 22 and the round ends (step 1112). If it is determined in step 1114 that the word written in step 1112 is not the word on the card (step 1116), the actor and the drawer both lose a point. If it is correct (step 11118), then the drawer is awarded one point or, if the round is more than two minutes, he receives nothing. If the correct answer is found within a minute, the actor is awarded two points. If not, the actor gets nothing. Then, in step 1120, a new actor is appointed, and the game is played again. The first person to get ten points on the scoreboard 40 wins the game.

Figure 12A:
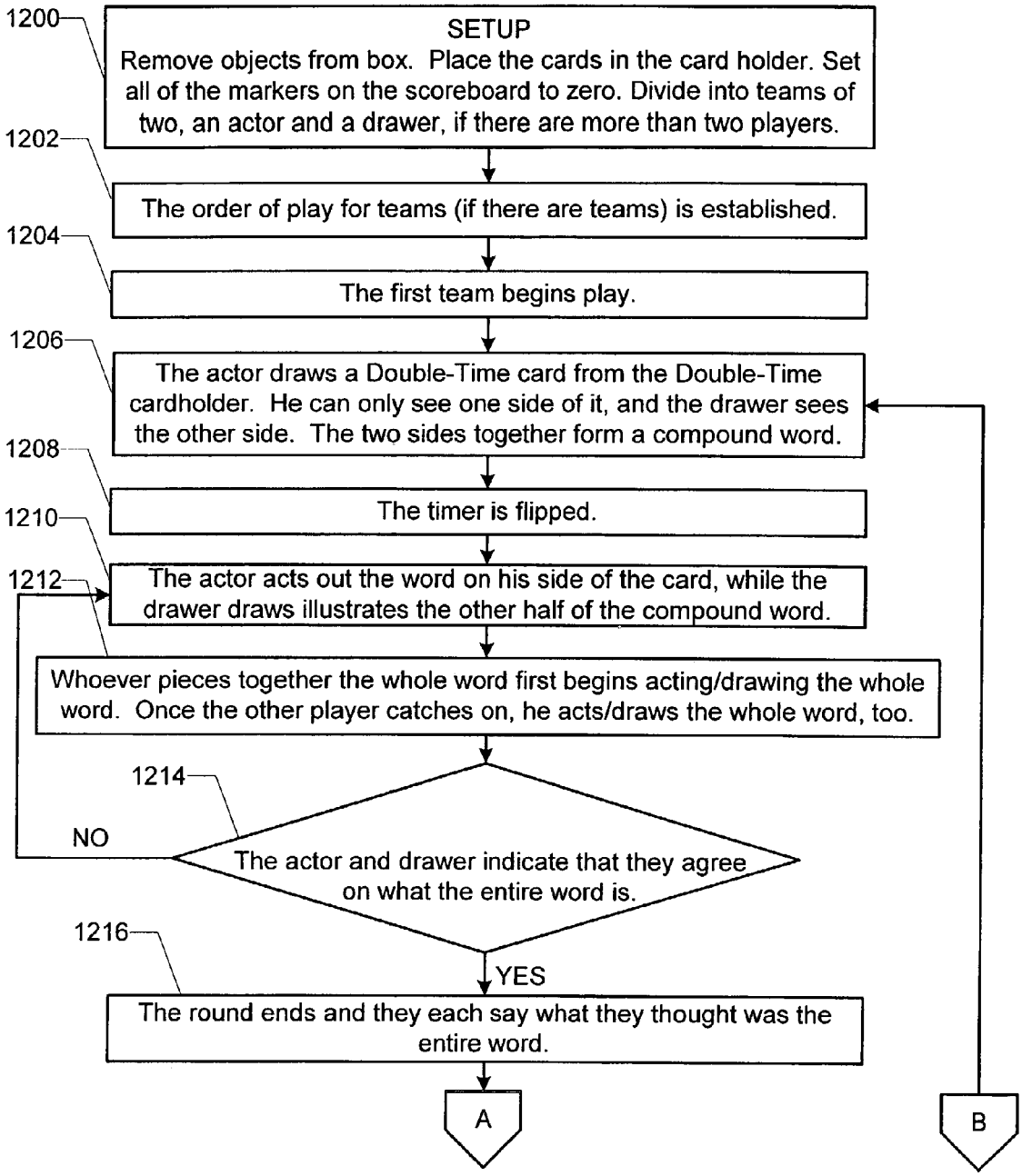
FIG. 12 is a flowchart showing the steps of a fourth preferred embodiment of the inventive game.
Figure 12B:
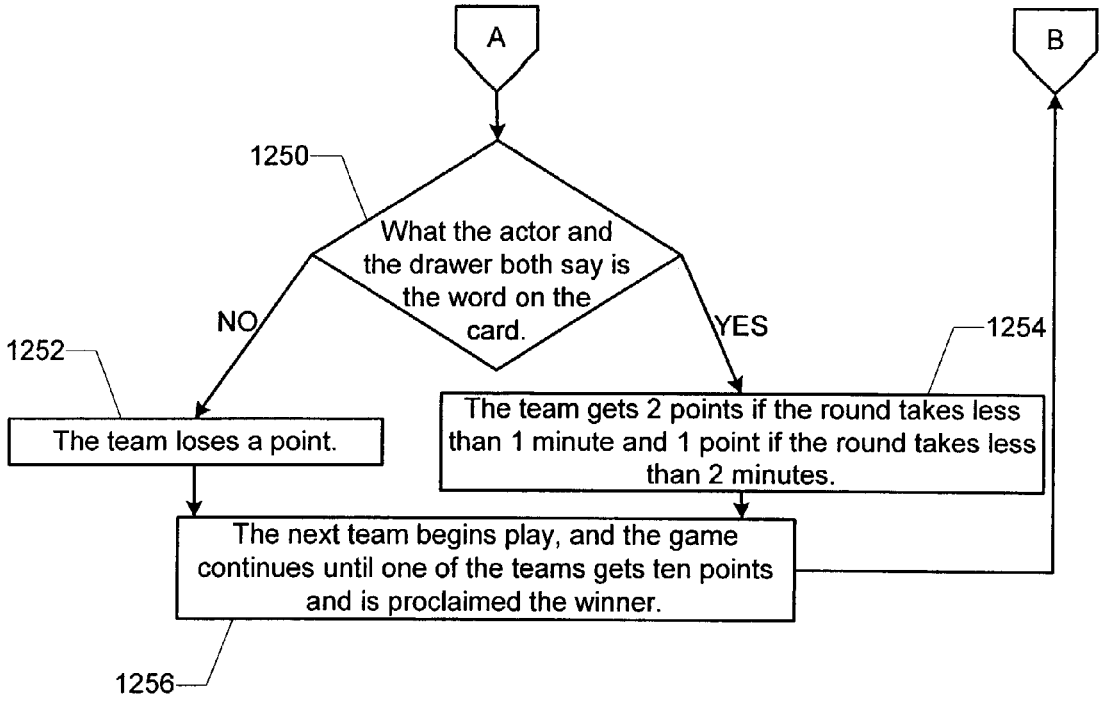
Figure 13:
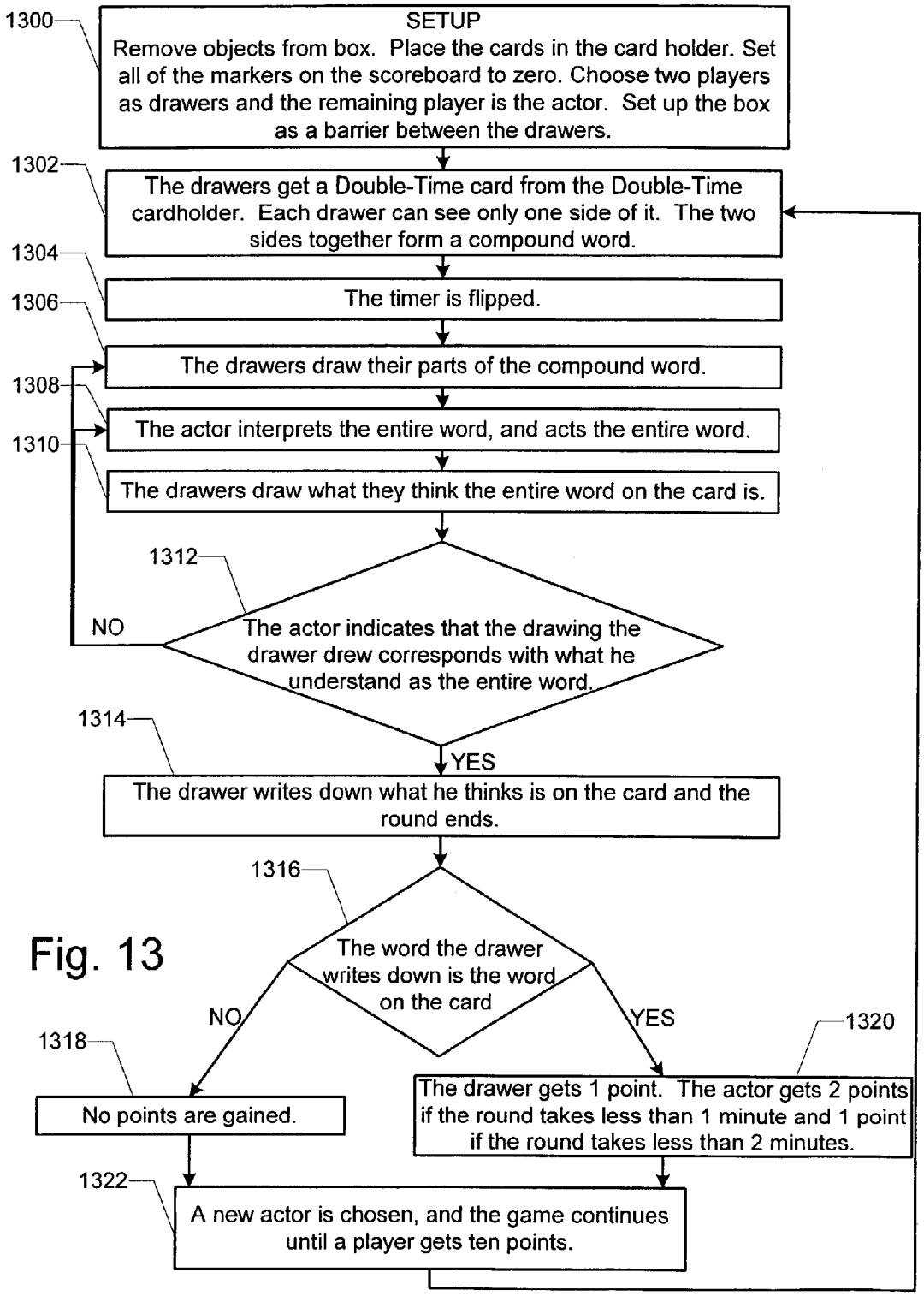
FIG. 13 is a flowchart showing the steps of a fifth preferred embodiment of the inventive game.
Figure 14:
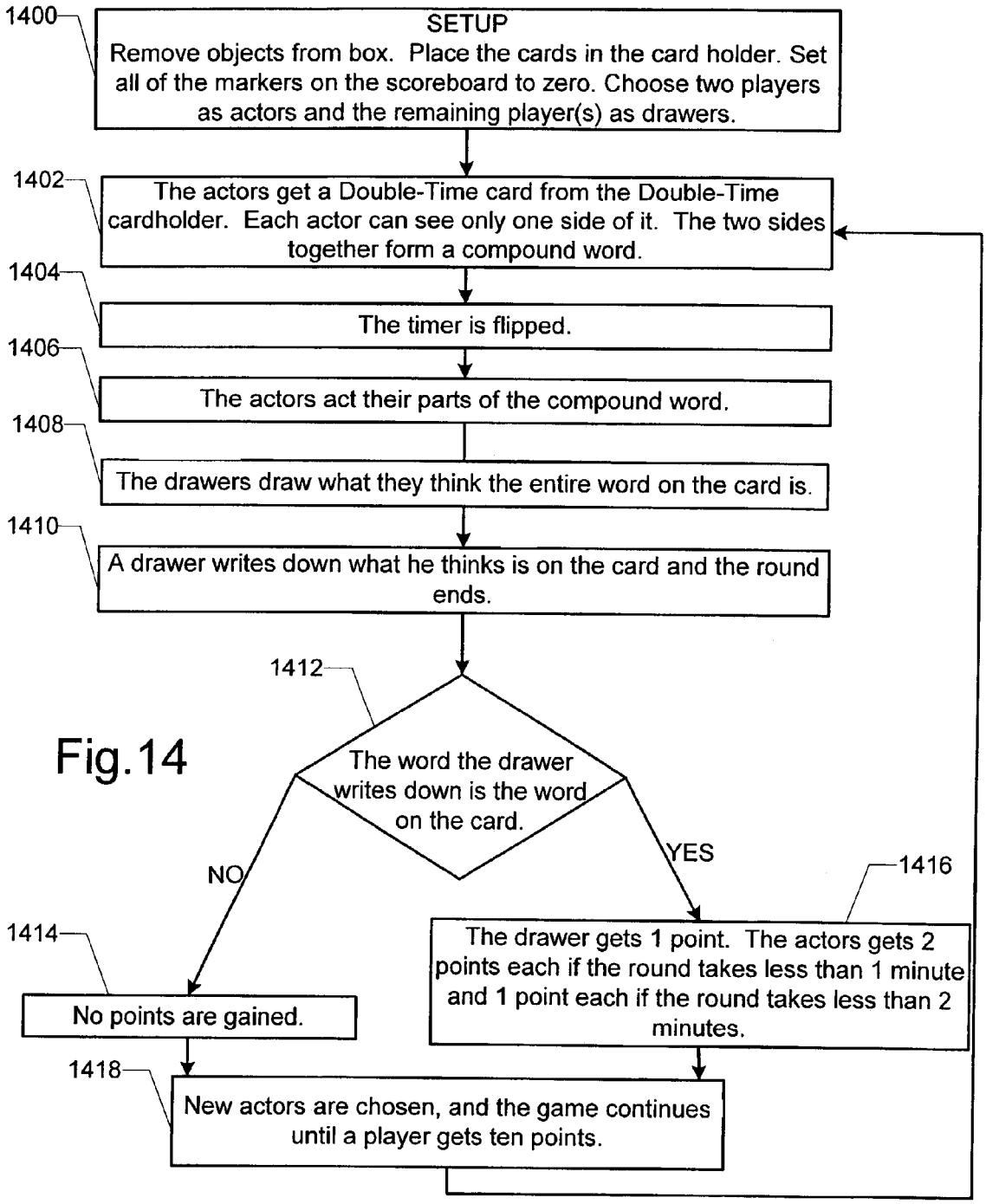
FIG. 14 is a flowchart showing the steps of a sixth preferred embodiment of the inventive game.

Another embodiment, for two players only, is shown in FIG. 12A and FIG. 12B. FIG. 12A and FIG. 12B, while representing this embodiment, are also used for the team version of the Double-Time Pixades, and thus references 1202 and 1204, referring to the team game, are not used in a version without teams. In this option, referred to as "Double-Time Pixades," two players, one actor and one drawer, draw a card 50 (step 1206) from the Double-Time card holder 30. On one side of the card 50 is a word, e.g. "super." On the other is, for example, "man." Each player sees a different word (step 1206). When the timer 10 is flipped (step 1208), the actor tries to act the word he saw, and the drawer tries to draw an illustration 21 of the word he saw (step 1210). When one of the two players understands the other and pieces together the entire compound word, he starts acting/drawing the entire word (step 1212). Once the other player understands what his partner is conveying, he draws/acts the entire word also. If they think they are in agreement (step 1214), they say what they thought the word was and then reveal the card 50 (step 1216). If it is determined in step 1250 (FIG. 12B) that they are correct (step 1254) and the round took less than a minute, they get two points. If they are correct and the round took less than two minutes, they get one point. If it took longer than two minutes, they are awarded nothing. If they are incorrect (step 1252), they lose a point. The object of the game is to get to ten points on the scorecard 40 in the fewest number of tries (step 1256).

The previous embodiment can be played with teams, also. There must be at least two teams of two players each. This is played in the same manner that Basic Team Pixades is played, except with the Double-Time card and Double-Time rules.

The penultimate embodiment to be described herein is a game for three players referred to as "Return to Sender." In step 1300, two of these players will be chosen as drawers, and the box 80 will be set on its side between the drawers as a barrier to ensure that neither drawer can see the other's dry-erase board 20. Then each drawer will receive half of a compound word from the Double-Time card holder 30 (step 1302) and, when the timer 10 is flipped (step 1304), will draw it (step 1306), attempting to convey his half of the idea to the remaining player, the actor, who will try to interpret the entire thing (1308). After he accomplishes this, he will act the entire thing (step 1308). The drawers draw what they think the entire word on the card 50 is, based on their card 50 and the actor's acting (step 1310). If the actor indicates that the drawing is correct (step 1312), the drawer writes down a word 22 what he thinks the entire word is and the round ends (step 1314). If it is determined in step 1316 that the word the drawer wrote down is correct (step 1320), he is awarded one point. Two points are given to the actor should the round take less than one minute. Only one point will be awarded to the actor if the round is less than two minutes, and no points will be awarded should the round be longer than two minutes. If it is incorrect (step 1318), no points are awarded. Then a new actor is chosen, and the game continues until a player nets ten points (step 1322).

The final embodiment to be included in this description, referred to as "Two Can Act at That Game" is to be played by three or more players. Two are chosen as actors, and those remaining will be drawers (step 1400). Each actor receives half of a compound word from the Double-Time card holder 30 (step 1402). The timer is flipped (step 1404) and they then try to act out their half of the idea to the drawers (step 1406). The drawers, interpreting the acting of both actors, draw the entire idea (step 1408). Then the drawer ends the round by writing down the word 22 (step 1410). If it is determined in step 1412 that the word the drawer wrote down corresponds to the word on the card 50, one point is awarded (step 1416) to the drawer. Two points are given to each actor should the round take less than one minute (step 1416). Only one point will be awarded to each actor if the round is less than two minutes, and no points will be awarded should the round be longer than two minutes (step 1416). If the word the drawer wrote down did not correspond with the word on the card 50, no points are gained (step 1414). Then new actors are chosen, and the game continues until a player gets ten points (step 1418).

Restrictive statements in the attached description are intended to describe the specific embodiments and not the invention in general.

Although the present invention and its advantages have been described in detail, it should be understood that various changes, substitutions and alterations could be made herein without departing from the spirit and scope of the invention. For example, the actors and drawers can be switched in any of the games described above. While non-verbal communications methods are described, other communications methods can be used, such as verbally communicating but not explicitly saying the word or phrase on the card. Moreover, the scope of the present application is not intended to be limited to the particular embodiments of the process, machine, manufacture composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the invention is intended to include within its scope such processes, machines, manufacture, compositions of matter, means, methods, or steps.

The invention claimed is:

1. A method of playing a game, comprising:

selecting from a deck a card having displayed thereon a word, phrase, or image to be seen by a first player and not by a second player;

activating a timing device;

attempting by the first player to communicate the word, phrase or image to a second player by acting;

attempting by the second player to understand the word or phrase;

attempting by the second player to convey to the first player by drawing the second player's understanding of what the word, phrase or image is;

stopping play when the first player considers that the second player has correctly deduced the word, phase or image, a round being considered successful if the second player has successfully deduced the word, phrase or image within a specified time as determined by the timing device; and tracking the players progress based on successful rounds.

2. A method of playing a game, comprising:

selecting from a deck a card having displayed thereon a word, phrase, or image to be seen by a first player and not by a second player;

activating a timing device;

attempting by the first player to communicate the word, phrase or image to a second player by drawing;

attempting by the second player to understand the word or phrase;

attempting by second player to convey to the first player by acting the second player's understanding of what the word, phrase or image is;

stopping play when the first player considers that the second player has correctly deduced the word, phrase or image, a round being considered successful if the second player has successfully deduced the word, phase or image within a specified time as determined by the timing device; and tracking the players progress based on successful rounds.

3. A method of playing a game, comprising:

selecting by one or more first players a card having displayed thereon one or more words to be conveyed to one or more second players;

activating a timing device;

acting out by the one or more first players the one or more words;

attempting by the one or more second players to deduce from the acting the one or more words;

attempting by the one or more second players to convey by drawing their understanding of the one or more words;

deducing by the one or more first players from the drawings whether the one or more second players have accurately determined the one or more words;

when the one or more first players believe that the one or more second players have accurately determined the one or more words, determining whether the one or more second players have accurately determined the one or more words within a specified time limit; and tracking the players' progress based on whether the one or more second players have accurately understood the one or more words and conveyed that understanding to the one or more first players within the specified time limit.

4. The method of claim 3 further comprising:

dividing the multiple first players into two or more teams; and assigning multiple second players to the two or more teams, and in which attempting by the one or more second players to deduce from the acting the one or more words includes attempting by the second players to understand the first communication from one or more first players on any team; and attempting by the one or more second players to convey by drawings their understanding of the one or more words includes each of the second players attempting to convey his or her understanding of the one or more words to first players on his or her own team.

5. The method of claim 3 in which:

acting out by the one or more first players the one or more words includes acting out by a single one of the first players; and attempting by the one or more second players to deduce from the acting the one or more words includes attempting by the multiple second players to deduce from the acting the one or more words.

* * * * *